US009662704B2

(12) United States Patent
Winograd

(10) Patent No.: US 9,662,704 B2
(45) Date of Patent: May 30, 2017

(54) METHOD FOR FORMING A SPIRAL SUPPORT STRUCTURE WITH CONTINUOUS WIRE COIL

(76) Inventor: Marius S. Winograd, Sparrow Bush, NY (US)

( * ) Notice: Subject to any disclaimer, the term of this patent is extended or adjusted under 35 U.S.C. 154(b) by 1081 days.

(21) Appl. No.: 13/253,326

(22) Filed: Oct. 5, 2011

(65) Prior Publication Data

US 2013/0089750 A1 Apr. 11, 2013

(51) Int. Cl.

| | |
|---|---|
| ***B21F 3/00*** | (2006.01) |
| ***B21F 3/02*** | (2006.01) |
| ***B21F 3/04*** | (2006.01) |
| ***B21F 27/12*** | (2006.01) |
| ***B21F 45/00*** | (2006.01) |
| ***E04C 5/06*** | (2006.01) |

(52) U.S. Cl.

CPC ..... *B21F 3/04* (2013.01); *B21F 3/02* (2013.01); *B21F 27/12* (2013.01); *B21F 45/00* (2013.01); *E04C 5/0604* (2013.01); *Y10T 428/12333* (2015.01)

(58) Field of Classification Search

CPC ..... B21C 37/045; B21F 27/121; B21F 3/04; B21F 3/02; B21F 45/00; B21F 27/12; E04C 5/0604; Y10T 428/12333

See application file for complete search history.

(56) References Cited

U.S. PATENT DOCUMENTS

| | | | | |
|---|---|---|---|---|
| 674,538 | A | 5/1901 | Martin | |
| 2,684,087 | A | 7/1954 | Stockton | |
| 3,562,082 | A * | 2/1971 | Van Buskirk | D04H 3/02 140/3 R |
| 3,592,243 | A | 7/1971 | Fukushima et al. | |
| 3,604,180 | A | 9/1971 | Wood | |
| 3,826,287 | A | 7/1974 | Tolliver | |
| 3,837,372 | A | 9/1974 | Bernot | |
| 3,882,905 | A | 5/1975 | James | |
| 4,487,000 | A | 12/1984 | Ball | |
| 4,746,075 | A | 5/1988 | Hoxit | |
| 5,097,646 | A | 3/1992 | Lamle | |
| 5,365,715 | A | 11/1994 | Steinmetz et al. | |

(Continued)

FOREIGN PATENT DOCUMENTS

| | | |
|---|---|---|
| BE | 834393 | 2/1976 |
| CA | 1002467 | 12/1976 |

(Continued)

OTHER PUBLICATIONS

International Search Report; International Application No. PCT/US12/58967; Mailed: Jan. 2, 2013.

*Primary Examiner* — David Bryant
*Assistant Examiner* — Pradeep C Battula

(57) ABSTRACT

The invention is a method for forming a continuous strand of wire into a spiral support structure. The method includes winding a continuous strand of wire around a first central axis into a primary spiral. The primary spiral thereafter is stretched linearly to form an elongated spiral of desired pitch, which is then wound around a second central axis to form spiral support structure. This resulting spiral support structure can have two or more sides. The amount of sides depends on ratio of first axis to the second axis along with the pitch of the spiral. The crest and depressions of the structure are linearly aligned, and are parallel to each other.

6 Claims, 9 Drawing Sheets

(56) References Cited

U.S. PATENT DOCUMENTS

| | | | | |
|---|---|---|---|---|
| 5,803,444 | A | 9/1998 | Shibuya et al. | |
| 5,966,811 | A * | 10/1999 | Zalusky | B21F 3/04 140/124 |
| 6,136,023 | A | 10/2000 | Boyle | |
| 6,148,873 | A | 11/2000 | Mehre | |
| 6,485,524 | B2 | 11/2002 | Strecker | |
| 7,412,993 | B2 | 8/2008 | Tzeng | |
| 7,594,523 | B2 | 9/2009 | Koussaifi | |
| 7,905,119 | B2 * | 3/2011 | Pinkowski | D06F 39/008 392/397 |
| 8,066,036 | B2 * | 11/2011 | Monetti | B21F 45/00 140/103 |

FOREIGN PATENT DOCUMENTS

| | | |
|---|---|---|
| DE | 2351701 | 4/1975 |
| DE | 1909717 | 10/1976 |
| DE | 2646272 | 4/1978 |
| DE | 3433441 | 3/1986 |
| DE | 20315046 U1 | 12/2003 |
| FR | 2507231 | 12/1982 |
| GB | 2177730 | 1/1987 |
| JP | 07158077 | 6/1995 |
| SU | 505771 | 4/1976 |
| SU | 545733 | 5/1977 |
| SU | 916705 | 4/1982 |
| WO | 2005065863 | 7/2005 |
| WO | 2005116357 | 12/2005 |
| WO | WO 2005114120 A2 * | 12/2005 |

* cited by examiner

METHOD FOR FORMING A SPIRAL SUPPORT STRUCTURE WITH CONTINUOUS WIRE COIL

BACKGROUND

Wire structures (e.g., concrete reinforcement bars, building components, etc.) are generally constructed from a plurality of wire coils. The wire coils are connected together (e.g., welded, wire tied, etc.) to form the wire structures. The wire structures constructed from a plurality of wire coils are generally unable to withstand various forces (e.g., vertical pressure, horizontal pressure, etc.) on the structure. Thus, there is a need in the art for an improved continuous wire coil and coiling method.

SUMMARY

One approach is a method that provides a continuous wire coil. The method includes winding a continuous strand of wire around a first rod to form a primary coil. The method further includes stretching the primary coil to form a primary spiral. The method further includes winding the stretched primary spiral around a second rod to form a secondary spiral.

Another approach is a continuous wire coil. The continuous wire coil includes a continuous wire wound in a double-spiral and a generally sinusoidal form aligned along a central axis. The continuous wire is connected together at one or more intersecting points formed by the sinusoidal form.

Another approach is an apparatus that provides for coiling a continuous wire coil. The apparatus includes a means for winding a continuous strand of wire around a first rod to form a primary coil. The apparatus further includes a means for stretching the primary coil to form a primary spiral. The apparatus further includes a means for winding the stretched primary spiral around a second rod to form a secondary spiral.

Any of the approaches described herein can include one or more of the following examples.

In some examples, the method further includes automatically and repeatedly winding the continuous strand of wire, stretching the primary coil, and winding the stretched primary spiral.

In other examples, the method further includes attaching one or more connected points of the secondary spiral together to form the continuous wire coil.

In some examples, the attaching the connected point further includes welding the one or more connected points.

In other examples, the first rod has a first diameter and the second rod has a second diameter. In some examples, the first diameter is a different size than the second diameter.

In other examples, the method further includes modifying the first diameter and/or the second diameter to modify a link space in the secondary spiral.

In some examples, the stretching the primary coil expands spacing of the continuous strand of wire.

In other examples, the method further includes applying pressure to the continuous strand of wire during winding the continuous strand of wire.

In some examples, the method further includes applying pressure to the stretched primary spiral during winding the stretched primary spiral.

In other examples, the winding the continuous strand of wire is in a first direction and the winding the stretched primary spiral is in a second direction.

In some examples, the first direction is different than the second direction.

In other examples, the continuous wire coil forms part of a building member, a tunnel structure, a bridge structure, a pole structure, and/or a pipeline structure.

In some examples, the continuous wire coil is a unitary piece of wire.

In other examples, the double-spiral forms link spacing between the one or more intersecting points.

In some examples, the continuous wire coil is formed from a spool of wire.

In other examples, the continuous wire is metal.

In some examples, the continuous wire coil includes a plurality of sides. The plurality of sides is formed by a size of each of the double-spirals.

In other examples, the apparatus further includes means for attaching one or more connected points of the secondary spiral together to form the continuous wire coil.

The wire coil technology described herein can provide one or more of the following advantages. An advantage of the technology is that the coiling method creates a synergistic effect over the unwound wire by dramatically increasing the strength of the coil with respect to the strength of the unwound wire. Another advantage of the technology is that the wire coil is easy to manufacture from a spool of wire, thereby decreasing the cost of manufacturing the wire coil. Another advantage of the technology is that the wire coil is easy to manufacture at any location, thereby increasing the available uses of the wire coil by decreasing transportation costs and increasing installation flexibility.

BRIEF DESCRIPTION OF THE DRAWINGS

The foregoing and other objects, features and advantages will be apparent from the following more particular description of the embodiments, as illustrated in the accompanying drawings in which like reference characters refer to the same parts throughout the different views. The drawings are not necessarily to scale, emphasis instead being placed upon illustrating the principles of the embodiments.

DETAILED DESCRIPTION

Figure 1:
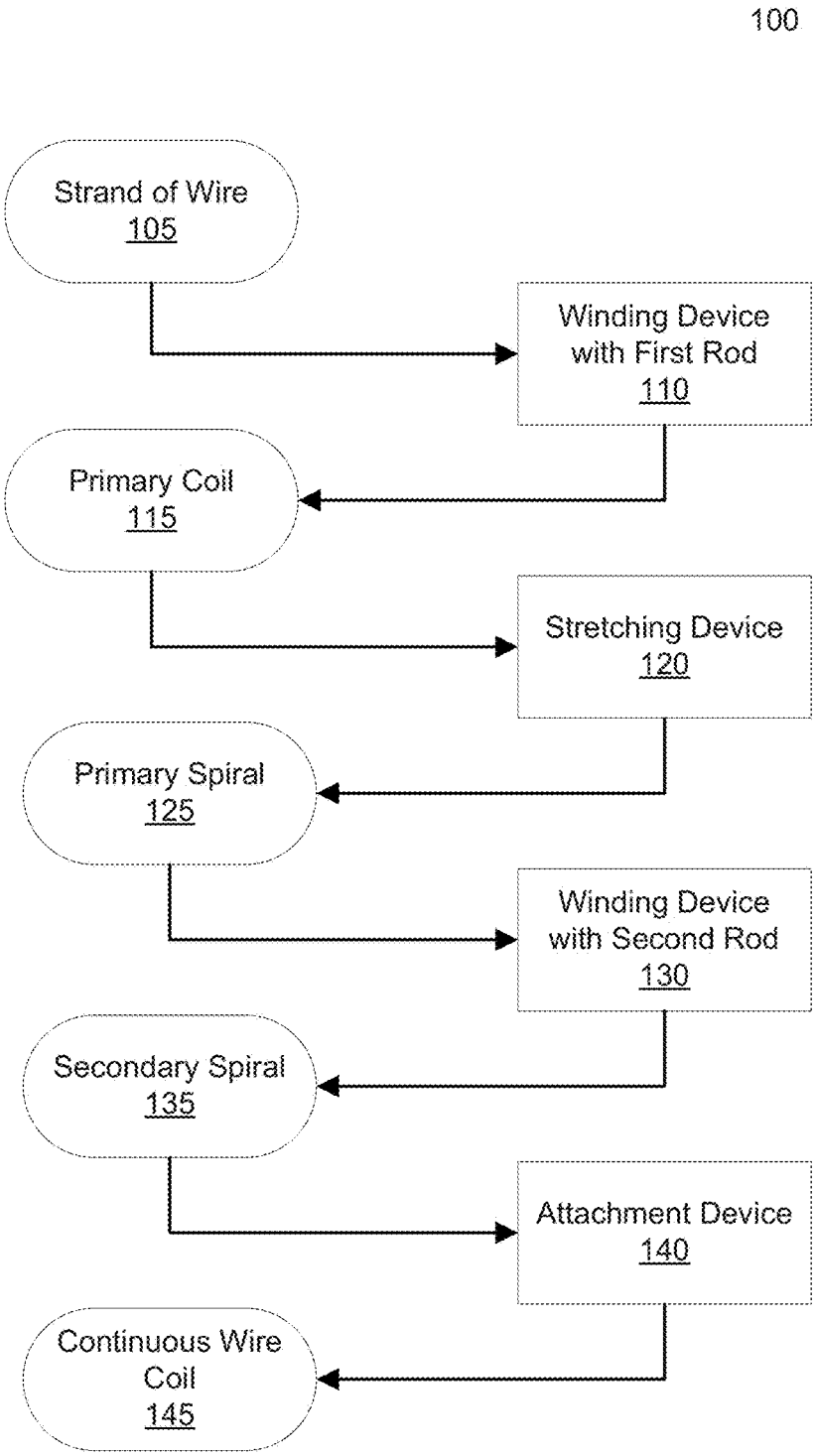
FIG. 1 is a diagram of an exemplary wire coiling process.

Wire coil technology, as described herein, can include a wire coil and a process of coiling the wire. The wire coil can be utilized in a stand-alone application (e.g., underground tunnel, culvert, etc.), integrated into other components (e.g., concrete reinforcement, coated in rubber for a pipeline, etc.), and/or attached to other components (e.g., inner reinforcement for a pipeline, internal building structure, etc.). The wire coil can be flexible and strong, thereby enabling the wire coil to be utilized in a variety of environments (e.g., pipeline in a earthquake prone environment, tunnel is a coastal environment, etc.). The flexibility of the wire coil enables the wire coil to flex in a changing environment (e.g., earthquake, wind, etc.) while still maintaining the strength to distribute loads (e.g., distribute earth about a tunnel, protect a pipeline from collapse, etc.).

In operation, the process of coiling the wire can include the following steps:

1. Wind a continuous strand of wire around a first rod with a first diameter (e.g., ten centimeter diameter, fifty centimeter diameter, etc.) to form a primary coil. The formation of the primary coil can form the initial winding of the wire into the wire coil that is utilized to size (e.g., horizontal size, vertical size, etc.) the wire coil. For example, a wire coil with a ten meter diameter is initially sized via the first winding step.

2. Stretch (e.g., stretch to double the original length, stretch to 1.5 the original length, etc.) the primary coil to expand the spacing of the wire to form a primary spiral. The stretching of the primary coil can be utilized to strengthen the wire coil (e.g., distributing the load horizontally, distributing the load vertically, etc.) by separating the wire during the formation of the primary spiral.

3. Wind the stretched primary spiral around a second rod with a second diameter (e.g., thirty centimeter diameter, two centimeter diameter, etc.) to create a secondary spiral (also referred to as a weave). The winding of the stretched primary spiral can form the double-spiral that is utilized to distribute loads through the wire coil while maintaining flexibility.

In some examples, the process further includes 4. Attaching (e.g., welding, bonding, etc.) the connected points of the secondary spiral together to form the wire coil. The attaching of the connected points can increase the strength of the wire coil (e.g., vertical compression strength, horizontal compression strength, etc.) by interconnecting the wire together to distribute any loads across the wire coil.

In other examples, the process of coiling the wire is a continuous method (steps 1, 2, 3, and/or 4 described above) and the steps can be completed sequentially with a continuous strand of wire. The continuous method decreases the cost of manufacturing by simplifying the process for manufacturing long wire coils. Although the continuous method is described as being utilized for long wire coils, the continuous method can be utilized for any length wire coil.

In some examples, the processing of coiling the wire is a non-continuous method (steps 1, 2, 3, and/or 4 described above). For example, in operation, step 1 is completed for a length of wire; then step 2 is completed for the length of wire; then step 3 is completed for the length of wire; and/or finally, step 4 is completed for the length of wire. The non-continuous method decreases the cost of manufacturing the wire coil by simplifying the process for manufacturing short wire coils. Although the non-continuous method is described as being utilized for short wire coils, the non-continuous method can be utilized for any length wire coil.

Generally, the wire coil is a continuous wire that is wound in a spiral along a longitudinal central axis of the wire coil. The wire coil is aligned along the central axis and connected together at intersecting points which increases the strength of the wire coil (e.g., horizontal strength, vertical strength, etc.) by distributing (e.g., load is distributed across the arches in the wire coil, load is distributed down the wires, etc.) any load across the length of the wire coil. The wire coil is a unitary piece that is turned along a longitudinal central axis, thereby decreasing the manufacturing cost and increasing the strength of the wire coil by evenly distributing loads through the wire coil.

FIG. 1 is a diagram of an exemplary wire coiling process 100. The process 100 starts with a strand of wire 105 being feed (e.g., manually fed, automatically fed, etc.) to a winding device 110 with a first rod (e.g., five centimeter diameter, ten centimeter diameter, etc.). The winding device 110 can be a rotating drum, a drill with an attached rod, a lathe, and/or any type of device that can wind wire. The length of the first rod can be based on the size of the wire coil. For example, a wire coil 145 is ten meters long and the first rod is eight meters long to fit a primary coil 115. In other examples, the length of the first rod is predetermined (e.g., one meter long, five hundred centimeters long, etc.). The winding device 110 winds the wire 105 around the first rod to form the primary coil 115. The primary coil 115 is the initial winding of the wire 105 into a spiral.

The primary coil 115 is fed (e.g., manually fed, automatically fed, etc.) to a stretching device 120. The stretching device 120 stretches the primary coil 115 to form a primary spiral 125. The stretching device 120 can be a hydraulic ram, a pneumatic piston, and/or any type of device that can stretch wire. The primary coil 115 can be stretched a random length and/or a predetermined length (e.g., 150% of the length of the primary coil 115, ten meters, etc.). The stretching of the primary coil 115 can advantageously increase the strength of the wire coil by separating out the wire, thereby increasing the load limits on the wire coil.

The primary spiral 125 is fed (e.g., manually fed, automatically fed, etc.) to a winding device 130 with a second rod (e.g., ten centimeter diameter, five centimeter diameter, etc.). The winding device 130 can be a rotating drum, a drill with an attached rod, a lathe, and/or any type of device that can wind wire. In some examples, the winding device 110 and the winding device 130 are the same type of winding device. In other examples, the winding device 110 and the winding device 130 are different types of winding devices. The winding device 130 winds the primary coil 125 around the second rod (e.g., different diameter from the first rod, same diameter as the first rod, etc.) to form a secondary spiral 135. The secondary spiral 135 is the double-spiral and generally sinusoidal form of the wire coil. The double-spiral and generally sinusoidal form of the wire coil can advantageously distribute any loads along the wire coil (e.g., horizontal distribution, vertical distribution, etc.).

In some examples, the secondary spiral 135 is fed (e.g., manually fed, automatically fed, etc.) to an attachment device 140. The attachment device 140 can be a welding device, a robot welding device, a cold welding device, an adhesive device, and/or any other type of device that can attach the wire. The attachment device 140 attaches one or more connected points on the secondary spiral 135 together to form a continuous wire coil 145 that provides additional strength along the longitudinal axis of the wire coil. The continuous wire coil 145 can be utilized for a variety of applications (e.g., tunnel, building support, pole, etc.).

In some examples, the first rod and the second rod have the same diameter (e.g., ten centimeters, thirty centimeters, etc.), thereby enabling the continuous wire coil 145 to be formed with a symmetrical aspect. In other examples, the first rod and the second rod have different diameters (e.g., the first rod has a ten centimeter diameter and the second rod has a twenty centimeter diameter, the first rod has a one centimeter diameter and the second rod has a three centimeter diameter, etc.), thereby enabling the continuous wire coil 145 to be formed with different numbers of sides (e.g., six sided continuous wire coil 145, three sided continuous wire coil 145, etc.). The sizes between the first rod and the second rod can be defined by a ratio and various ratios can be utilized to form different numbers of sides. For example, a ratio of 1:2 (first rod diameter to second rod diameter) is utilized to form four sides of the continuous wire coil 145. The different number of sides advantageously enables the technology to be utilized for a variety of applications (e.g., a six sided continuous wire coil for a building application, a four sided continuous wire coil for a tunnel application, etc.). For example, a three sided continuous wire coil is more flexible than a six sided continuous wire coil. As another example, a six sided continuous wire coil is stronger than a three sided continuous wire coil.

In other examples, the winding device 110 and/or the winding device 130 applies pressure to the wire 105 and/or primary spiral 125, respectively. The application of pressure enables the continuous wire coil 145 to be formed with different number of sides. In some examples, the ratio between the diameters of the first rod and the second rod and the application of pressure is utilized to form different number of sides for the continuous wire coil 145. In other examples, the ratio between the diameters of the first rod and the second rod and the application of pressure is utilized to form various link spacing in the continuous wire coil 145. The link spacing is the size of the opening in the continuous wire coil 145 between the wire and/or intersecting points. For example, the link spacing has an area of ten square centimeters. As another example, the link spacing has an area of twenty square centimeters. The link spacing can enable the formation of different size and/or strength continuous wire coils. The link spacing can advantageously increase the flexibility of the wire coil 200*a* while substantially maintaining the strength (e.g., 99% of the strength, 96% of the strength, etc.) of a similar wire coil without such link spacing. For example, a smaller link spacing (e.g., under one square centimeter, under ten square centimeters, etc.) is utilized to increase the strength of the continuous wire coil 145. In another example, a medium link spacing (e.g., between three and four square centimeters, between four and six square centimeters, etc.) is utilized to balance the strength of the continuous wire coil 145 and the use of wire in the continuous wire coil 145.

Figure 2A:
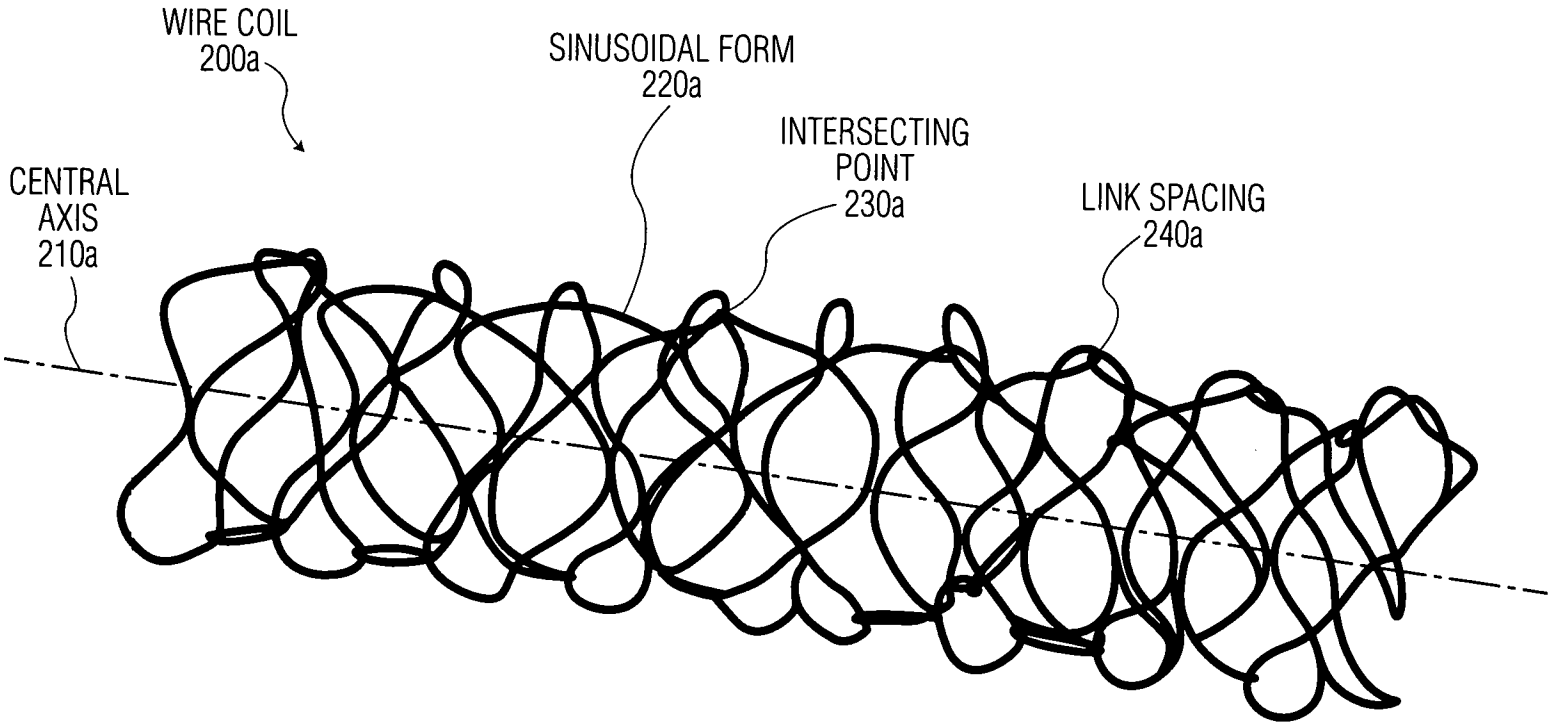
FIGS. 2A-2F are illustrations of exemplary wire coils.

FIG. 2A is an illustration of an exemplary wire coil 200*a*. The wire coil 200*a* includes a continuous wire that is would in a double-spiral aligned along a longitudinal central axis 210*a*. The wire coil 200*a* is generally in a sinusoidal form 220*a*. For example, the wire coil 200*a* is formed as a 98% sinusoidal form. As another example, the wire coil 200*a* is formed as a 95% sinusoidal form. The sinusoidal form 220*a* form as arch for the wire coil 200*a* between intersecting points 230*a*. The arch for the wire coil 200*a* advantageously increases the strength of the wire coil 200*a* by distributing the weight of a load across the length of the wire coil 200*a* (e.g., distributed through ten of the intersecting points, distributed across four inches of the wire coil 200*a*, etc.). The intersecting points 230*a* for link spacing 240*a* in the wire coil 200*a*. As described herein, the link spacing 240*a* can be sized based on a variety of parameters (e.g., strength, weight, cost, etc.).

Figure 2B:
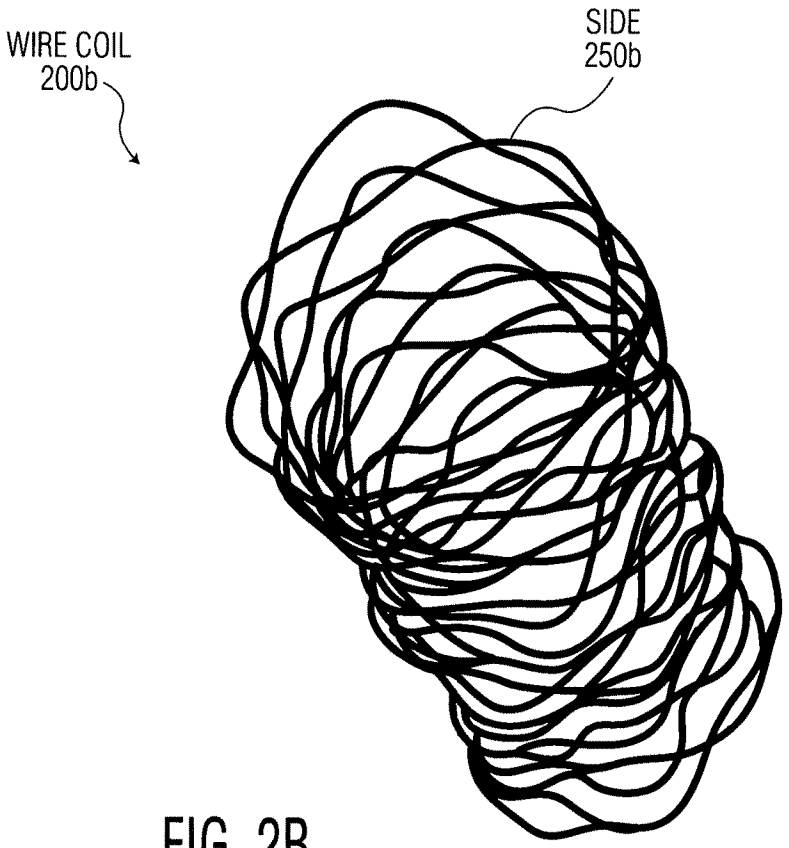

FIG. 2B is an illustration of another exemplary wire coil 200*b*. The wire coil 200*b* has five sides 250*a*. As described herein, the number of sides of the wire coil 200*b* can be formed based on the pressure applied during the winding processes and/or the ratio between the first rod and the second rod. The number of sides can be set based on the application (e.g., building member, bridge structure, tunnel structure, pipeline structure, pole structure, etc.) of the wire coil 200*b*.

Figure 2C:
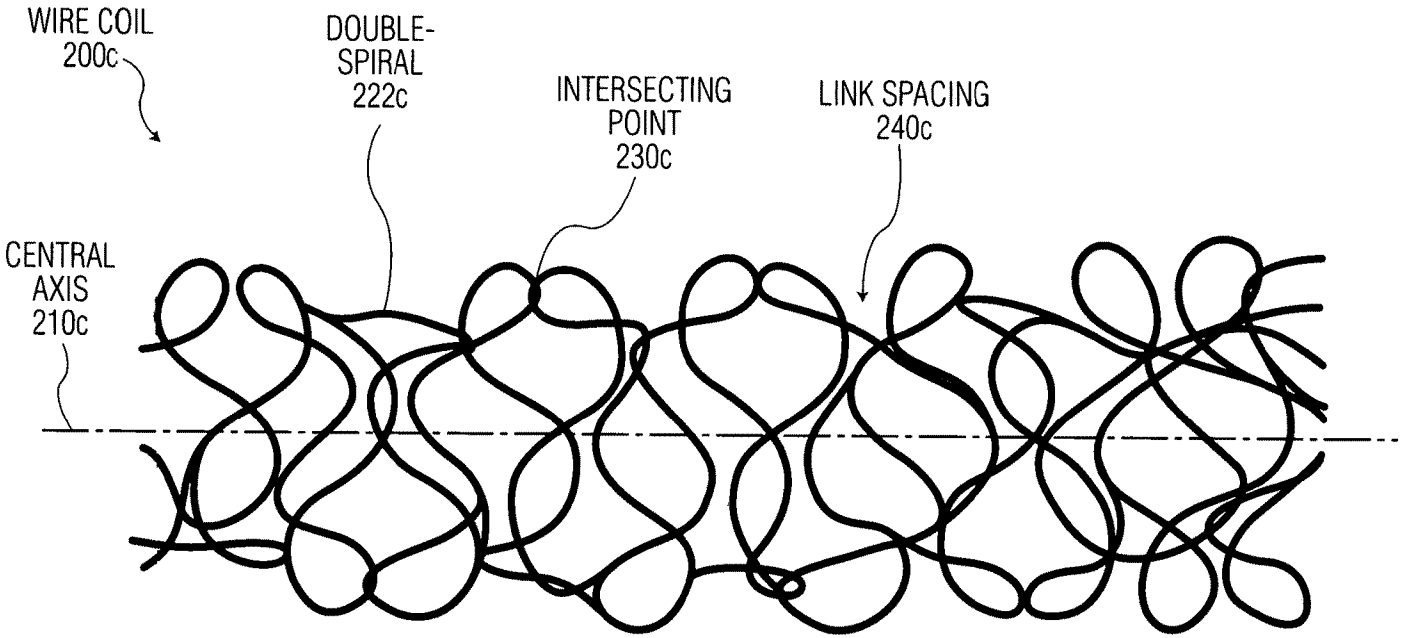

FIG. 2C is an illustration of another exemplary wire coil 200*c*. The wire coil 200*c* is wound in a double-spiral 222*c* aligned along a central axis 210*c* which forms a plurality of arches between intersecting points 230*c*. The intersecting points 230*c* form link spacing 240*c* between the intersecting points 230*c*.

Figure 2E:
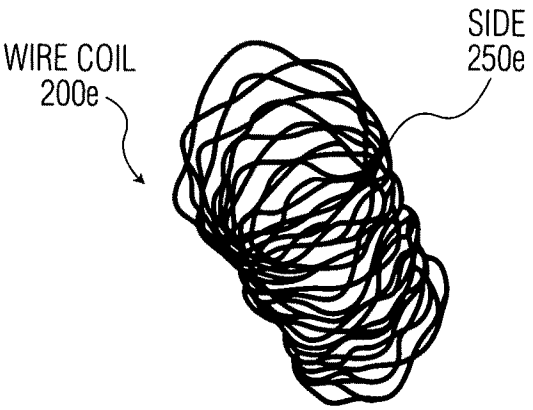
Figure 2F:
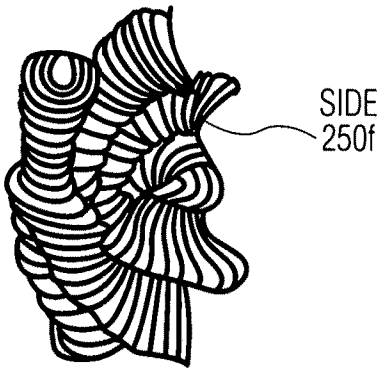
Figure 2D:
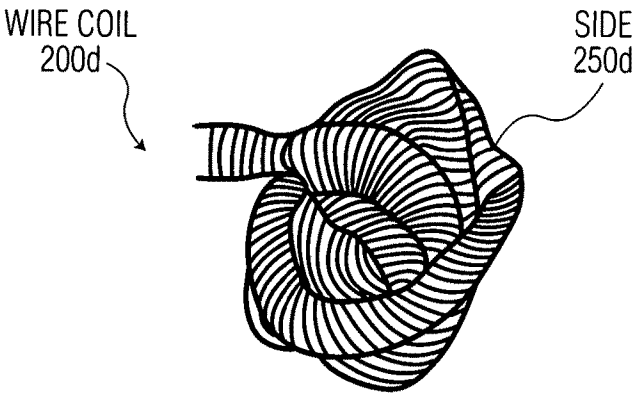

FIG. 2D is an illustration of another exemplary wire coil 200*d*. The wire coil 200*d* has four sides 250*d*.

FIG. 2E is an illustration of another exemplary wire coil 200*e*. The wire coil 200*e* has five sides 250*e*.

FIG. 2F is an illustration of another exemplary wire coil 200*f*. The wire coil 200*f* has seven sides 250*f*. The wire coil 200*f* can be any size (e.g., ten meters in length by one meter wide, twelve meters in length by two meters wide, etc.) and/or can be constructed from any type of material (e.g., plastic, metal, composite, etc.).

Figure 3:
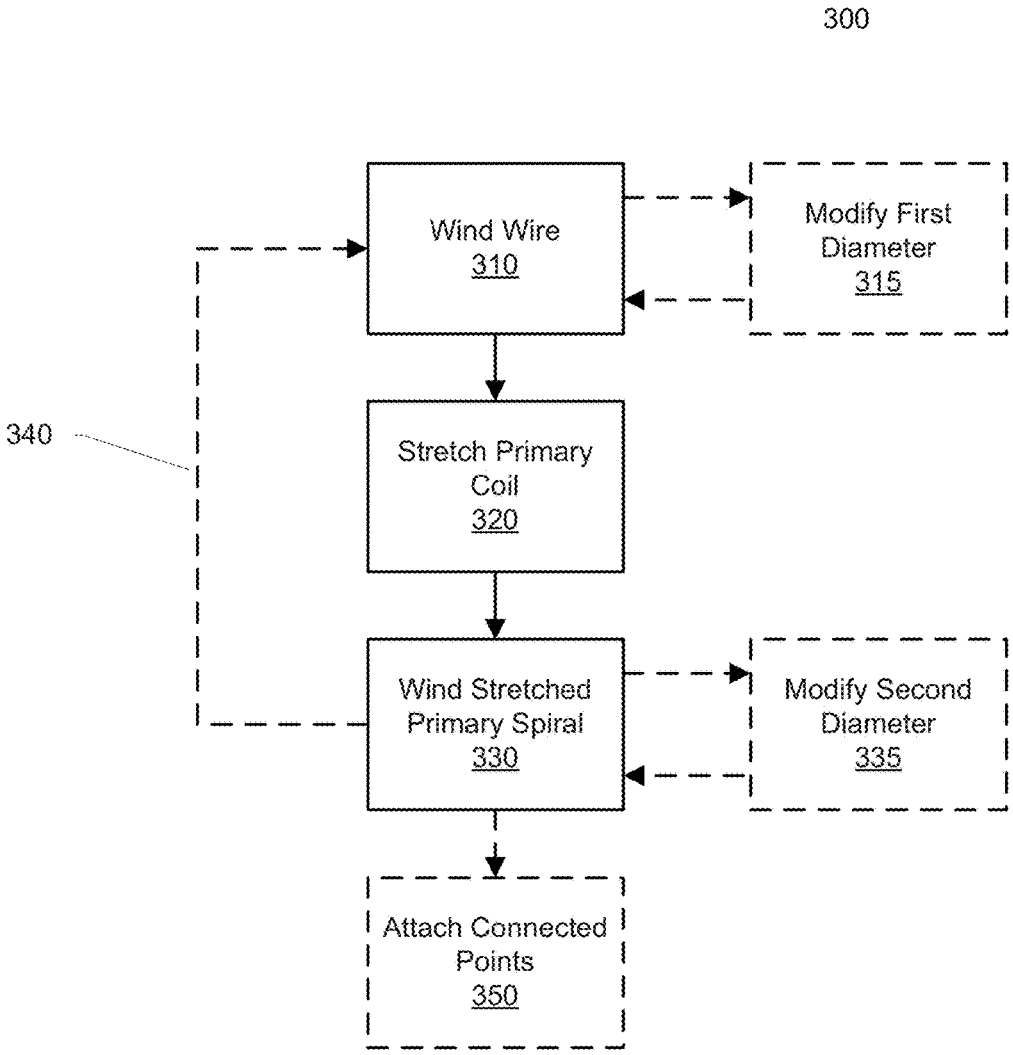
FIG. 3 is a diagram of another exemplary wire coiling process.

FIG. 3 is a diagram of another exemplary wire coiling process 300 utilizing, for example, a coiling apparatus. The coiling apparatus winds (310) a continuous strand of wire around a first rod to form a primary coil. The coiling apparatus stretches (320) the primary coil to form a primary spiral. The coiling apparatus winds (330) the stretched primary spiral around a second rod to form a secondary spiral.

In some examples, the coiling apparatus automatically and repeatedly (340) winds (310) the continuous strand of wire, stretches (320) the primary coil, and winds (330) the stretched primary spiral. The automatic and repeating (340) of part of the process advantageously enables the coiling apparatus to quickly and efficiently manufacture wire coils.

In other examples, the coiling apparatus attaches (350) one or more connected points of the secondary spiral together to form the continuous wire coil. In some examples, the attaching (350) the connected point further includes welding the one or more connected points.

In some examples, the first rod has a first diameter and the second rod has a second diameter. In other examples, the first diameter is a different size than the second diameter.

In some examples, the coiling apparatus modifies (315) the first diameter and/or modifies (335) the second diameter to modify a link space in the secondary spiral. In other examples, the stretching (320) the primary coil expands spacing of the continuous strand of wire.

In some examples, the coiling apparatus applies pressure (e.g., application of pad on wire, tightening of fed mechanism, etc.) to the continuous strand of wire during winding the continuous strand of wire. In other examples, the coiling apparatus applies pressure (e.g., application of pad on wire, tightening of fed mechanism, etc.) to the stretched primary spiral during winding the stretched primary spiral.

In some examples, the winding (310) the continuous strand of wire is in a first direction (e.g., clockwise, counter-clockwise) and winding (320) the stretched primary spiral is in a second direction (e.g., clockwise, counter-clockwise, etc.). In other examples, the first direction is different than the second direction.

Figure 4A:
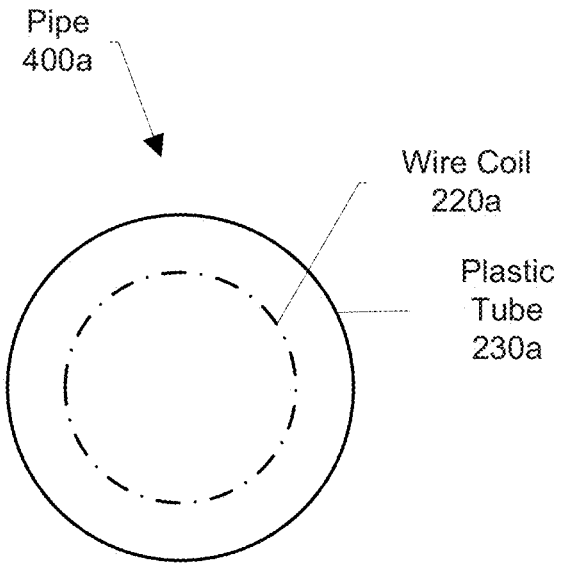
FIGS. 4A-4B are diagrams of exemplary pipes.

FIG. 4A is diagram of an exemplary pipe 400*a*. The pipe 400*a* includes an inner wire coil 220*a* and an outer plastic tube 230*a*. The plastic tube 230*a* can be placed over the wire coil 220*a*. In other examples, the plastic tube 230*a* is sprayed on the wire coil 220*a*. The pipe 400*a* can be utilized for fluid delivery (e.g., water, gas, oil, etc.).

Figure 4B:
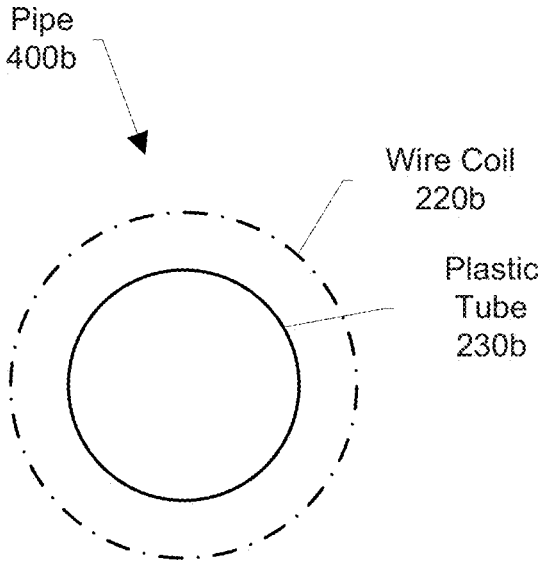

FIG. 4B is diagram of an exemplary pipe 400*b*. The pipe 400*b* includes an inner plastic tube 230*b* and an outer wire coil 220*b*. The plastic tube 230*b* can be placed within the wire coil 220*b*. In other examples, the plastic tube 230*b* is sprayed into the wire coil 220*b*. FIGS. 4A and 4B illustrate exemplary configurations of pipes. Other configurations and/or types of pipes and/or coatings can be utilized with the wire coil. The use of the wire coil 220*b* and the plastic tube 230*b* advantageously enables the pipe 400*b* to be strong (e.g., high compression strength, low risk of collapse, etc.) and flexible. Although FIG. 4B illustrates the inner plastic tube 230*b* inside the outer wire coil 220*b*, the pipe 400*b* can, for example, include an outer plastic tube (not shown) and the inner plastic tube 230*b*.

Figure 5:
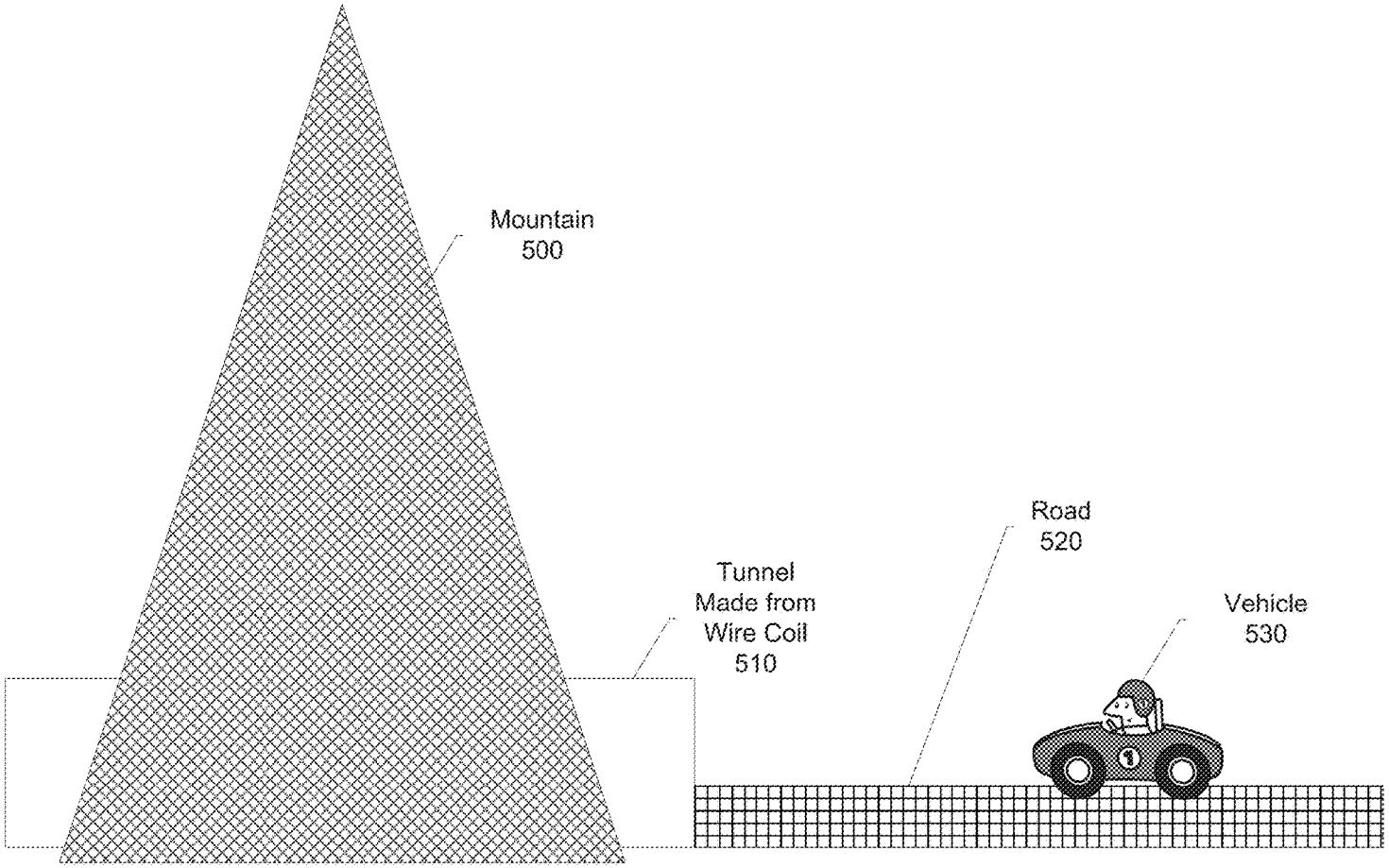
FIG. 5 is a diagram of an exemplary tunnel.

FIG. 5 is a diagram of an exemplary tunnel 510 made from a wire coil. The tunnel 510 is within a mountain 500. As illustrated in FIG. 5, a vehicle 530 can travel down a road 520 through the tunnel 510. The wire coil utilized in the tunnel 510 construction advantageously enables the tunnel to be quickly manufactured and strengthens the load bearing capabilities of the tunnel 510. The wire coil can be, for example, the structural support for the tunnel 510. The wire coil can be coated in protective materials (e.g., rust inhibitor, protection from water, etc.) and/or can be covered by other construction materials (e.g., concrete, asphalt, insulation, etc.).

Figure 6:
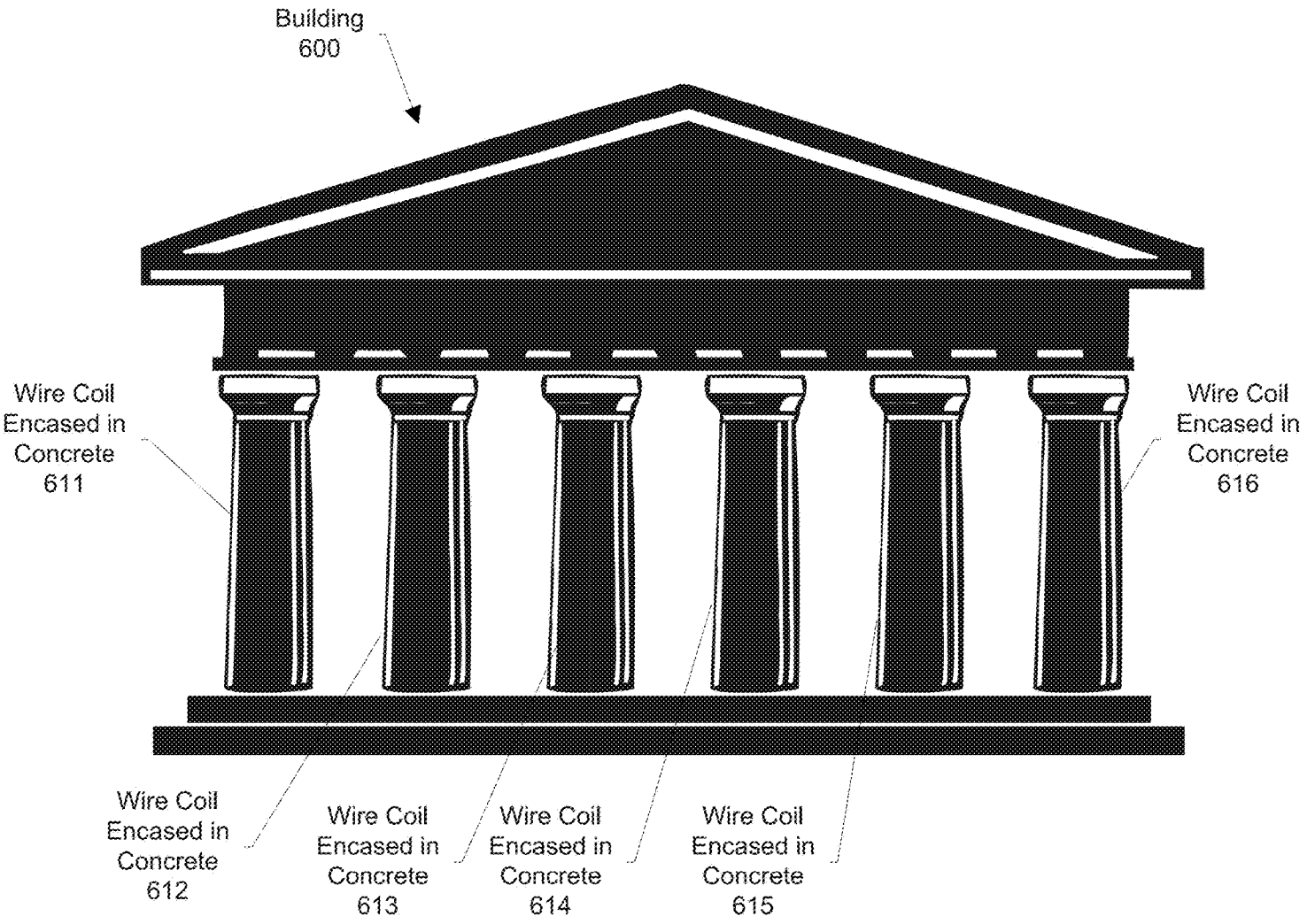
FIG. 6 is a diagram of an exemplary building.

FIG. 6 is a diagram of an exemplary building 600. The building 600 includes a plurality of wire coils encased in concrete 611, 612, 613, 614, and 615. The wire coils 611, 612, 613, 614, and 615 are utilized as structural supports for the building 600 and as reinforcement bars for the concrete. The wire coils utilized in the construction of the building 600 decreases the construction cost and increases the strength of the building 600.

In some examples, the continuous wire coil is a unitary piece of wire (e.g., single piece, multiple pieces bonded together, etc.). In other examples, the double-spiral forms link spacing between the one or more intersecting points.

In some examples, the continuous wire coil is formed from a spool of wire. In other examples, the continuous wire is metal. In some examples, the continuous wire coil includes a plurality of sides. The plurality of sides is formed by a size of each of the double-spirals.

One skilled in the art will realize the invention may be embodied in other specific forms without departing from the spirit or essential characteristics thereof. The foregoing embodiments are therefore to be considered in all respects illustrative rather than limiting of the invention described herein. Scope of the invention is thus indicated by the appended claims, rather than by the foregoing description, and all changes that come within the meaning and range of equivalency of the claims are therefore intended to be embraced therein.

What is claimed is:

1. A method of forming a continuous strand of wire into a spiral support structure, said method comprising: winding the continuous strand of wire about a first central axis to form a primary coil; stretching the primary coil to form a primary spiral of a desired pitch; winding the primary spiral about a second central axis to form the spiral support structure which is comprised of crests and depressions that are linearly aligned; and attaching adjacent crests or depressions to increase the rigidity of the spiral support structure.

2. The method according to claim 1, wherein the spiral support structure has two or more sides.

3. The method according to claim 1, wherein winding about the first central axis defines a diameter of the primary coil and winding about the second central axis defines a diameter of the spiral support structure.

4. The method according to claim 3, wherein the ratio of the diameter of the primary coil to the diameter of the spiral support structure and the pitch of the stretched primary coil determines a number of sides of the spiral support structure.

5. The method according to claim 1, wherein the continuous strand of wire is composed of metal.

6. The method according to claim 1, wherein the continuous strand of wire is composed of polymeric material.

* * * * *